United States Patent [19]

Lashmore

[11] Patent Number: 4,461,680

[45] Date of Patent: Jul. 24, 1984

[54] PROCESS AND BATH FOR ELECTROPLATING NICKEL-CHROMIUM ALLOYS

[75] Inventor: David S. Lashmore, Frederick, Md.

[73] Assignee: The United States of America as represented by the Secretary of Commerce, Washington, D.C.

[21] Appl. No.: 567,451

[22] Filed: Dec. 30, 1983

[51] Int. Cl.[3] ..... C25D 3/56; C25D 5/14

[52] U.S. Cl. ..... 204/41; 204/43 R; 204/43 T; 204/DIG. 9

[58] Field of Search ..... 204/43 R, 43 T, 123, 204/DIG. 9, 41

[56] References Cited

U.S. PATENT DOCUMENTS

| | | | |
|---|---|---|---|
| 1,918,605 | 7/1933 | Jones | 204/51 |
| 3,042,592 | 7/1962 | Schaer | 204/51 |
| 3,888,744 | 6/1975 | Stromatt et al. | 204/1.5 |
| 3,954,574 | 5/1976 | Gyllenspetz et al. | 204/43 T |
| 4,142,948 | 3/1979 | Tajima et al. | 204/43 R |

OTHER PUBLICATIONS

J. C. Saiddington et al., Plating, pp. 923–930, Oct. 1974.

*Primary Examiner*—G. L. Kaplan
*Attorney, Agent, or Firm*—Eugene J. Pawlikowski; Alvin J. Englert; Bernhard D. Saxe

[57] ABSTRACT

A process for the electrodeposition of a nickel chromium alloy on a cathodic substrate comprises:

contacting the substrate with an aqueous electrolyte containing: about 50–125 g/l of $CrCl_3.6H_2O$; about 10–125 g/l of $NiCl_2.6H_2O$; about 10–115 g/l of formic acid; about 25–50 g/l of boric acid; and about 50–100 g/l of sodium citrate dihydrate;

adjusting the pH of the bath to about 1–5 and the temperature to about 20°–60° C.; and passing a sufficient current through the solution and to the substrate to effect deposition thereon of a nickel-chromium alloy.

16 Claims, 4 Drawing Figures

FIG. 1
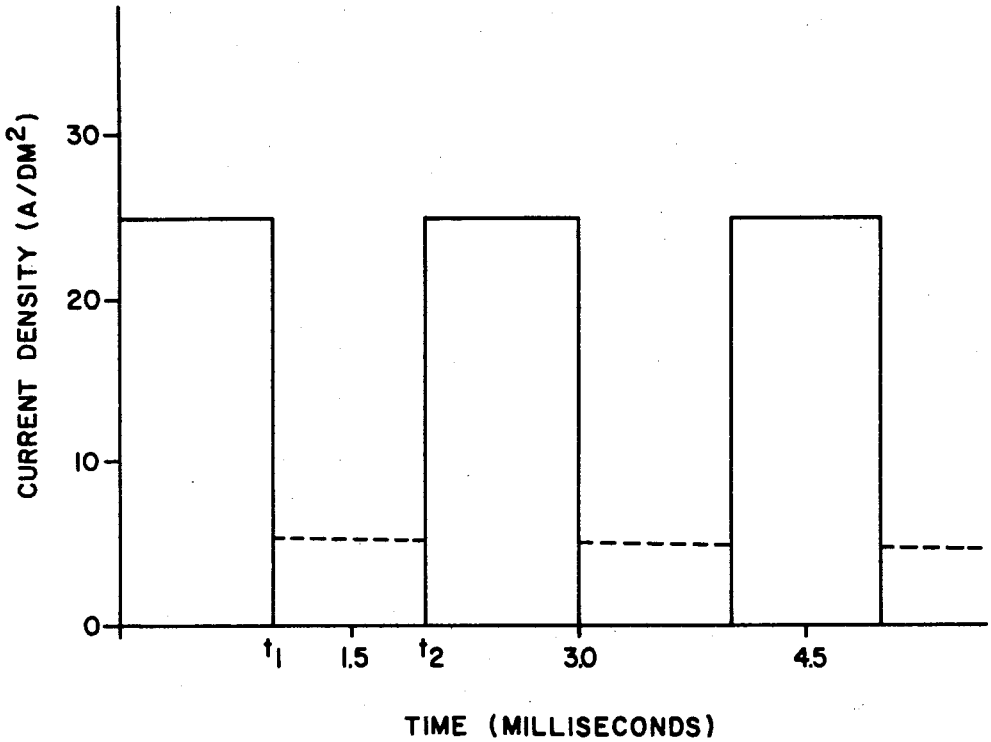
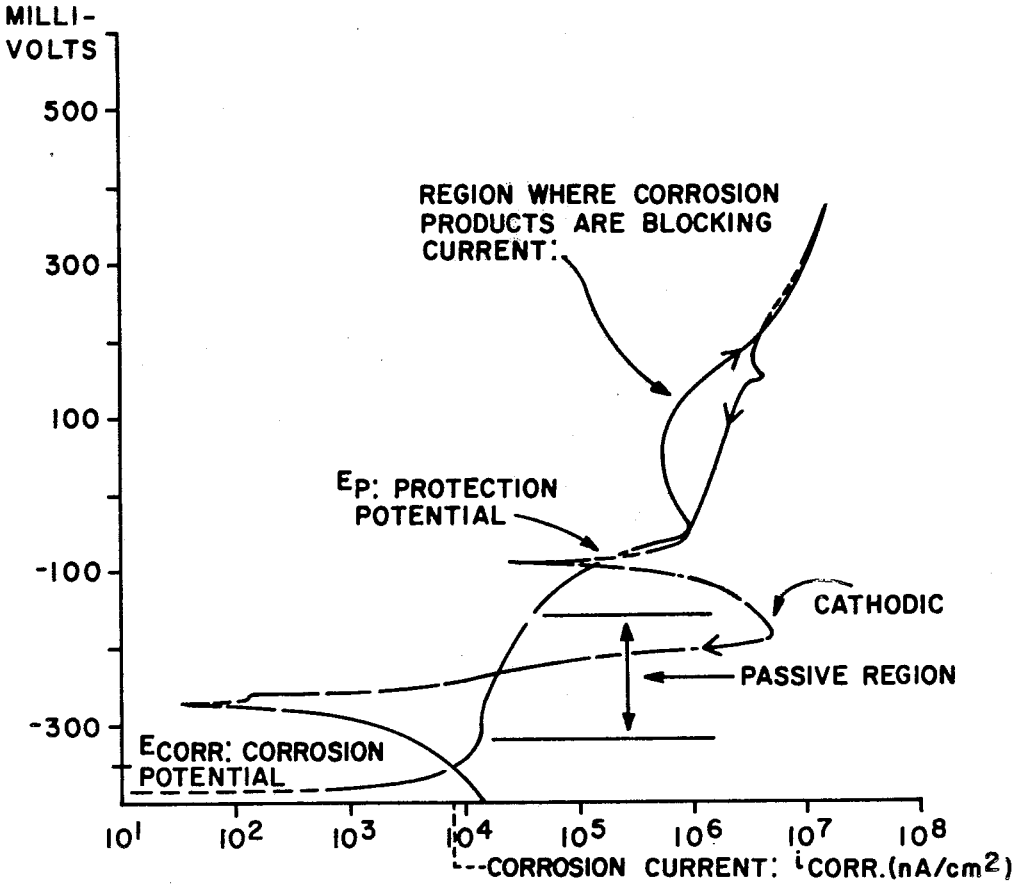
FIG. 4

PROCESS AND BATH FOR ELECTROPLATING NICKEL-CHROMIUM ALLOYS

BACKGROUND OF THE INVENTION

A great deal of effort has been expended to obtain a workable, commercially acceptable process for electroplating nickel-chromium alloys. Various combinations of complexing agents have been used with both trivalent and hexavalent chromium ions. However, it has not been possible until now to produce thick, high quality nickel-chromium deposits with high chromium contents.

The behavior of complex bimetallic electroplating baths is highly unpredictable. Minor changes in electrolyte compositions may result in the formation of different and/or new families of complex ions and may result in significantly poorer coating properties or even a process which will not work at all. Typical of the problems encountered by earlier workers in this field were (a) the inability to build up a coating of thickness greater than 25 microns, (b) inability to incorporate significant amounts of chromium into the deposit and (c) poor morphology, i.e., coatings which are highly stressed or dendritic. More recent efforts to overcome these problems have been partially successful, and have made use of, e.g., iron-nickel-chromium processes, pulsed electrodeposition and/or the use of hexavalent chromium. However, thick coatings of nickel-chromium alloy are very difficult to obtain from hexavalent electrolytes under normal conditions, and the use of hexavalent ions requires more energy for electrodeposition. Moreover, trivalent ions are also far easier to treat when present in electroplating waste than are hexavalent ions.

Although pulsed electrodeposition has been known for quite a long time, the affects on the deposit morphology of varying the parameters involved can only be qualitatively guessed at. Advances in the theory of pulsed electrodeposition still do not permit prediction in advance of either morphology or composition for complex alloy systems such as complex binary chromium alloy baths. Rather, the effects of both composition and variation of electrodeposition parameters for complex multicomponent systems can only be determined by exhaustive experimental work.

It was hoped that electrodeposited coatings of nickel-chromium alloys would have a number of properties which would be likely to attract wide commercial interest if an appropriate deposition process were found. Corrosion resistance was likely to be unusually high for materials with chromium alloy surfaces having a chromium content greater than about 20 weight percent. The wear performance, especially at higher temperatures, might be comparable to other commonly used coatings such as hard chromium and, if the coating could be applied using electrodeposition techniques, the adhesion between the coating and the substrate should be comparable to the cohesive strength of the substrate itself, with the additional advantage that the coating could be applied to the interior surfaces of very small parts. Protective wear- and corrosion- resistant coatings are becoming increasingly important since they permit the production of parts with high corrosion resistance and wear resistance without the necessity of making the entire part out of stainless steel.

A need therefore continues to exist for an efficient, commercially viable process for electrodeposition of thick nickel-chromium alloys having high and controllable chromium contents and excellent surface morphology, corrosion resistance and wear resistance.

OBJECTS OF THE INVENTION

One object of the present invention is to provide a process for electrodeposition of thick nickel-chromium alloys using a trivalent chromium salt in the electrolyte.

Another object of the present invention is to provide a process for electrodeposition of nickel-chromium alloys having a controllable chromium content of from about 0.1 weight percent to about 60 weight percent by appropriate choice of the deposition parameters.

A further object of the invention is to provide a process for electrodeposition of nickel-chromium alloys which are strongly adherent and which are resistant to wear and corrosion.

Yet a further object of the invention is to provide an electroplating bath suitable for use in electrodeposition of thick nickel-chromium alloys.

Yet another object of the invention is to provide articles of manufacture having a coating of nickel-chromium alloy produced by the electrodeposition process of the invention.

Upon further study of the specification and the appended claims, further objects and advantages of this invention will become apparent to those skilled in the art.

SUMMARY OF THE INVENTION

These objects can be achieved by a process for the electrodeposition of a nickel-chromium alloy on a cathodic substrate, comprising contacting the substrate with an aqueous electrolyte containing about 50–125 g/l of $CrCl_3.6H_2O$; about 10–125 g/l of $NiCl_2.6H_2O$; about 10–115 g/l of formic acid; about 25–50 g/l of boric acid; and about 50–100 g/l of sodium citrate dihydrate; adjusting the pH of the bath to about 1–5 and the temperature to about 20°–60° C.; and passing a sufficient current through the solution and to the substrate to effect deposition thereon of a nickel-chromium alloy.

The invention further provides an electrolyte for the electrodeposition of nickel-chromium coatings, and articles plated with nickel-chromium alloys, which are characterized by high corrosion resistance and wear resistance.

BRIEF DESCRIPTION OF THE DRAWINGS

Various other objects, features and attendant advantages of the present invention will be more fully appreciated as the same becomes better understood when considered in conjunction with the accompanying drawings, wherein:

FIG. 1 shows a typical waveform for pulsed deposition;

FIG. 4 is a typical voltammetry curve for a nickel-chromium alloy.

DETAILED DISCUSSION

Figure 2:
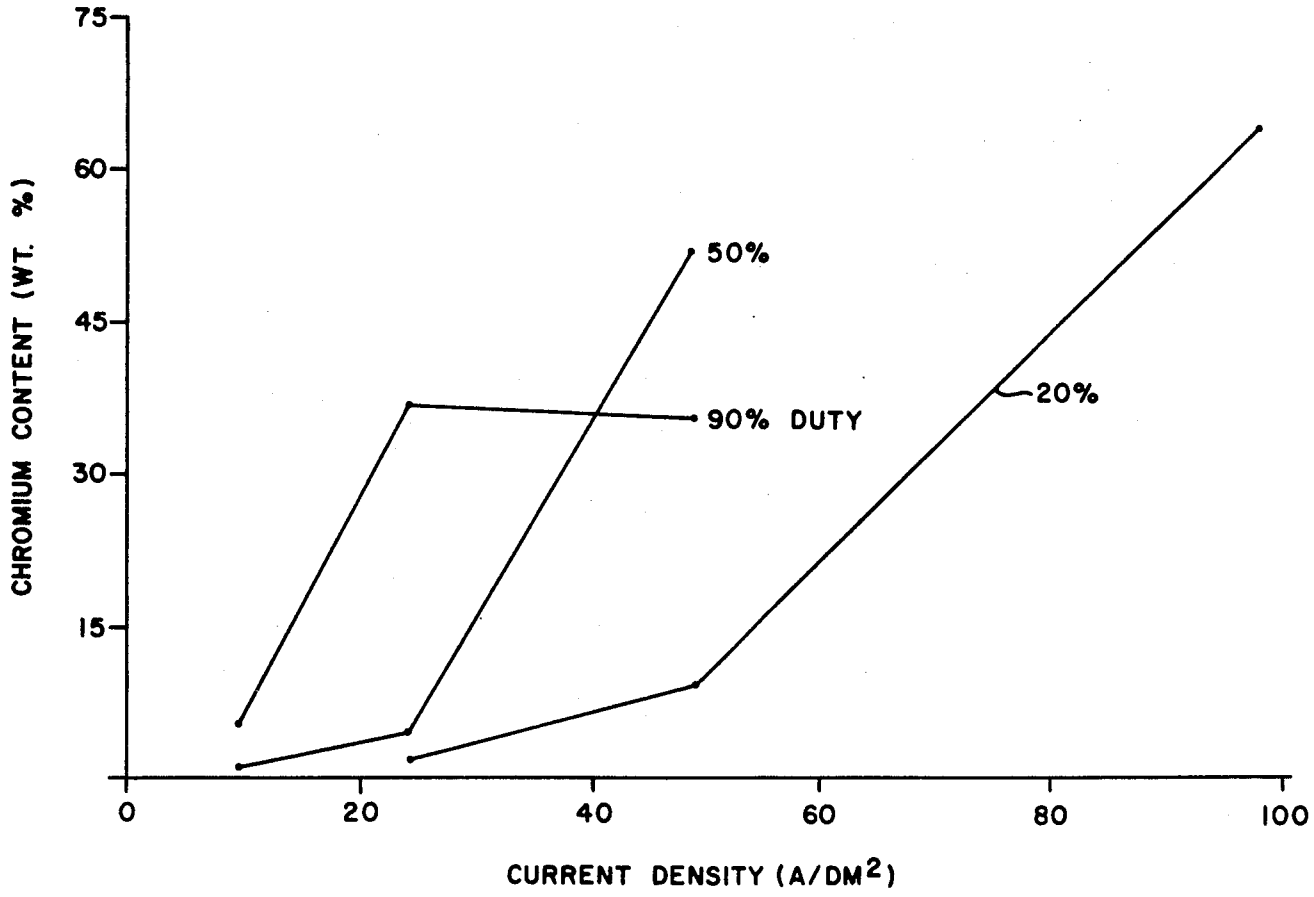
FIG. 2 is a plot of chromium content as a function of current density, for three different duty cycles.

The process of the invention is based upon the use of an electroplating bath containing trivalent chromium electrolytes. The amount of chromium in the electrolyte can be optimized conveniently by first fixing the concentration of nickel chloride hexahydrate at 30 g/l and varying the chromium chloride hexahydrate from 0 to 130 g/l. Measurements of the chromium content of the coating are made, e.g., by x-ray flourescence using the procedure described by Rasberry et al., *Anal. Chem.*, 46, 81 (1974). The chromium content of the deposit exhibits a peak at a solution content of 100 g/l of chromium hexahydrate. By fixing the amount of chromium in the electrolyte at 100 g/l, the nickel content can be optimized. By variation of the nickel chloride hexahydrate concentration in the electrolyte over a range of 5 to 125 g/l, a significantly smaller variation in the chromium content of the coating is found, although the chromium content peaks at about 30 g/l. Accordingly, a preferred electrolyte bath in the present process will contain about 100 g/l of chromium chloride hexahydrate and about 30–40 g/l of nickel chloride hexahydrate. It will be appreciated that the hydrated metal salts are used because they are readily available and less expensive than anhydrous nickel or chromium chlorides, although the latter could be used in amounts proportionately reduced to provide the same metal ion contents.

It is possible to substitute chromium sulfate for chromium chloride in the bath, but the alloy deposit is less satisfactory, and tends to be more brittle. It is also possible to substitute cobalt chloride for nickel chloride, and this may have advantages in certain applications because of the high temperature stability and desirable magnetic properties of chromium-cobalt alloys. A further advantage of chromium-cobalt is its inertness to degradation by body fluids, making it attractive for the coating of prostheses. It is also possible to omit nickel chloride and deposit thick, bright chromium coatings from the trivalent chromium bath. These coatings are comparable to those which were heretofore obtainable only from hexavalent chromium baths.

It is also possible to include a third or even more than one additional metallic alloy component, e.g., molybdenum, tungsten, vanadium, aluminum, iron and the like, as well as non-metallic elements such as phosphorus or boron.

Formic acid is an essential component of the plating bath according to the invention. It is generally available commercially as a 95% reagent (5% water for stabilization) having a density of about 1.22 g/ml. Formic acid acts primarily as a buffer and may also play a role in the reduction of trivalent chromium. It is likely that formic acid also is involved in complexing one or both of nickel and chromium ions.

The addition of alkali metal halides and/or ammonium halides is not necessary, although the presence of such salts appears to benefit the process of the invention. Bromide ion helps to avoid anodic formation of hexavalent chromium ion, since bromide oxidizes at a lower potential than does trivalent chromium ion. In principle, an iodide salt could also be used, although this would result in liberation of iodine at the anode. The presence of bromide ion may lead to the liberation of some bromine at the anode. The presence of ammonium ion appears to improve the quality of the deposit, probably due to formation of complexes with both nickel and chromium ions. It is advantageous to add sodium bromide and, in some cases, ammonium chloride to the plating bath, although it will be understood that ammonium bromide and sodium chloride, and/or potassium bromide, potassium chloride, and other combinations of alkali metal and halide ions, can be used. These salts also act to improve the conductivity of the electrolyte.

Boric acid was found to be essential to the plating bath, although its precise role is not understood. It may act to minimize hydrolysis reactions and it probably plays a role in the crystal growth process by absorption on certain crystal orientations. It will be appreciated that boric anhydride may be substituted, in the appropriate amounts, for boric acid in the aqueous plating bath.

Glycolic acid can be added to the plating bath of the invention, as a further complexing agent for the nickel and chromium ions. Glycine can be substituted for glycolic acid, but the glycine complexes do not appear to be as strongly bonded as the glycolic acid complexes, resulting in rapid nucleation and poorer coating quality. In addition, glycine is anodically decomposed and its reaction products degrade the coating. The presence of glycolic acid leads to a cracked deposit which is desirable for a lubricated surface. Cracking can be avoided by eliminating or significantly reducing the content of glycolic acid or by inclusion in the plating bath of a stress reliever, e.g., saccharin or other conventional stress relievers. The solubility of glycolic acid is quite high and considerably more is preferably added to the electrolyte of the invention than is necessary to complex the chromium and nickel. Substantially no affect on the chromium content of the deposit is observed by varying the amount of glycolic acid in the plating bath.

Citrate, or other equivalent polycarboxylic acid, is an essential component of the plating bath according to the invention. It also operates to form complexes with the nickel and chromium ions. Citrate may be added as the acid or, preferably, as an alkali metal salt, e.g., sodium citrate (dihydrate).

It is advantageous and common in the art to add a small amount of a conventional surfactant to the plating bath, e.g., a nonionic surfactant, e.g., polyethylene glycol ethers of alkylphenols, such as Triton X-100 (registered trademark of Rohm and Haas Company). It is advantageous to avoid ionic surfactants, especially sulfate-type surfactants.

It is sometimes advantageous to add thiourea or other scavengers for copper and/or zinc ions to the plating bath. This helps to minimize contamination of the alloy coating with copper ions. Further improvement in avoiding copper contamination can be achieved by plating at low current densities on a dummy cathode. Zinc contamination can be further improved by plating at high current densities on a dummy cathode. However, these problems are usually not serious in practice although they can become more serious when the substrate to be plated is brass or other copper- and/or zinc-containing alloy. It should also be noted that ammonium bromide is more tolerant of copper than sodium bromide, and may be advantageously substituted for sodium bromide to further improve plating morphology where copper contamination is a problem.

A preferred bath composition for the process of the invention is as follows (brackets indicate optional ingredients):

| Constituents | Amounts |
|---|---|
| $NiCl_2.6H_2O$ | 30–40 g/l |
| $CrCl_3.6H_2O$ | 100 g/l |
| Formic acid (95%) | 35–40 ml/l |
| [NaBr | 15 g/l] |

-continued

| Constituents | Amounts |
|---|---|
| [$NH_4Cl$ | 50 g/l] |
| Boric acid | 30–40 g/l |
| [Glycolic acid | 50 g/l] |
| Sodium citrate dihydrate | 80 g/l |
| [Triton X-100 | 1 drop/l] |

The pH of the plating bath is advantageously adjusted to between about 1 and about 5, preferably at about 3.5. The temperature of the bath is advantageously kept substantially constant, at a temperature from about 20° to about 60° C., preferably at about 35° C.

Plots of the percentage of chromium in the alloy deposit as a function of temperature and pH of the electrolyte, other factors being held constant, reveal that the amount of chromium in the alloy gradually decreases as temperature increases.

Measurements of the chromium content of the alloy at various pH values while also varying the temperature, using the chromium current efficiency as the dependent variable, showed that the efficiency goes through a minimum at about 55° C. and at a pH of 2. At a temperature of 30° C., deposits containing over 18 weight percent chromium are produced by direct current deposition. Significant improvements in deposit morphology are obtained by pulsed electrodeposition, as discussed in greater detail hereinafter.

Direct current deposition using the plating bath of the invention produces surprisingly and unexpectedly thick nickel-chromium alloy deposits having advantageous morphological characteristics. Either direct or pulsed current deposition according to the process of the invention can give nickel-chromium deposits at least 25 microns thick, and coatings of thicknesses of at least 50 microns, 75 microns, 100 microns, and even 125 microns have been achieved.

Even better deposits can be obtained using pulsed current deposition. Pulsing permits deposition of alloy compositions which cannot be obtained by direct current deposition. Moreover, it is possible to electronically control the coating composition and morphology by control of the pulsed current parameters.

In pulsed electrodeposition, there are four variables that are of primary importance. These are: (1) pulse height (peak current density); (2) base height (off time current density); (3) on time; and (4) off time.

Another parameter, which depends upon the foregoing, is the duty cycle, which is defined by the following equation (the period is the sum of the On Time and the Off Time):

$$\text{Duty Cycle} = (\text{On Time} / \text{Period}) \times 100\%$$

It had not been known previously how pulsed current deposition would affect the composition and the morphology of nickel-chromium electrodeposited alloys. The general theory of pulsed current deposition has shown that important affects on morphology and composition of the deposited metal coating can be produced by variation of the operating parameters. During the On Time, the concentration of both nickel and chromium ions is reduced within a certain diffusion distance from the cathode. This so-called diffusion layer pulsates with the same frequency as the applied current. Its magnitude is also related to the peak current density but reaches a limiting value governed primarily by the diffusion coefficient of the ions involved. During the Off Time, the concentration of the reactants builds up again and will reach the equilibrium concentration of the bulk electrolyte if enough time is allowed.

Typically, for frequencies of several hundred cycles per second (cps), the diffusion distance is significantly smaller than the corresponding diffusion distance for direct current deposition. If the diffusion distance is comparable to the dimensions of the surface roughness, then the asperities of the surface which protrude into the diffusion layer will be exposed to a concentration of the reactants which is higher than the average surface and will therefore experience a higher deposition rate. However, during pulsing, the average diffusion distance is usually small compared to the surface roughness so that the surface sees a substantially uniform concentration of ions even at its rough spots, with the result that the deposition rate is everywhere about the same. For this reason, pulsed current deposition can produce a significantly smoother deposit with suppression of dendrite formation. Conversely, the morphology of coatings deposited by direct current deposition will usually be more dendritic or nodular than coatings formed with pulsed deposition.

A wide variety of waveforms can be used for pulsed electrodeposition. It is convenient to use square waveforms, and these can be either square potential or square current waveforms. Square potential is advantageous in laboratory applications, since it permits better control of the nature of the reacting species. However, square potential pulsing requires a third electrode, which makes it less convenient for commercial application. Industrial plating processes usually use square current deposition, with sufficiently short deposition times that the composition is not significantly affected by variations in the potential. By proper control of the Duty Cycle and its constituent parameters, excellent deposition can be achieved using square current waveforms.

FIG. 1 illustrates how these parameters might be set for a typical square current pulsed electrodeposition: 25 $A/dm^2$ peak height; 0 $A/dm^2$ base height (solid line) or 5 $A/dm^2$ base height (dashed line); 1 msec On Time ($t_1$); 2 msec Period ($t_2$); 50% Duty Cycle ($t_1/t_2$).

One important advantage of the present process is that the resultant deposit grows in a layered structure with the layers exhibiting marked chromium concentration gradients. Scanning electron micrographs show layer spacings of about 2000–6000 Å.

It is believed that the layered microstructure of electrodeposited nickel-chromium coatings explains the extreme resistance to pitting shown by these alloy coatings. It is likely that corrosion would proceed into the coating until a layer is encountered, and would then spread laterally until the outer layer is dissolved, so that pitting is eliminated. Since the layer spacing of electrodeposited nickel-chromium alloy coatings produced according to the process of the invention is on the order of 0.2–0.6 micron, more than 100 layers would have to be uniformly dissolved in a 50 micron engineering coating before the underlying substrate could be attacked.

The nickel-chromium coatings produced according to the process of the invention exhibited unusual corrosion resistance in both chloride and sulfuric acid environments. In addition, microhardness measurements and dry sliding wear measurements were made and the latter revealed that the wear performance of these coatings exceeded the wear performance of electrodeposited nickel.

Figure 3:
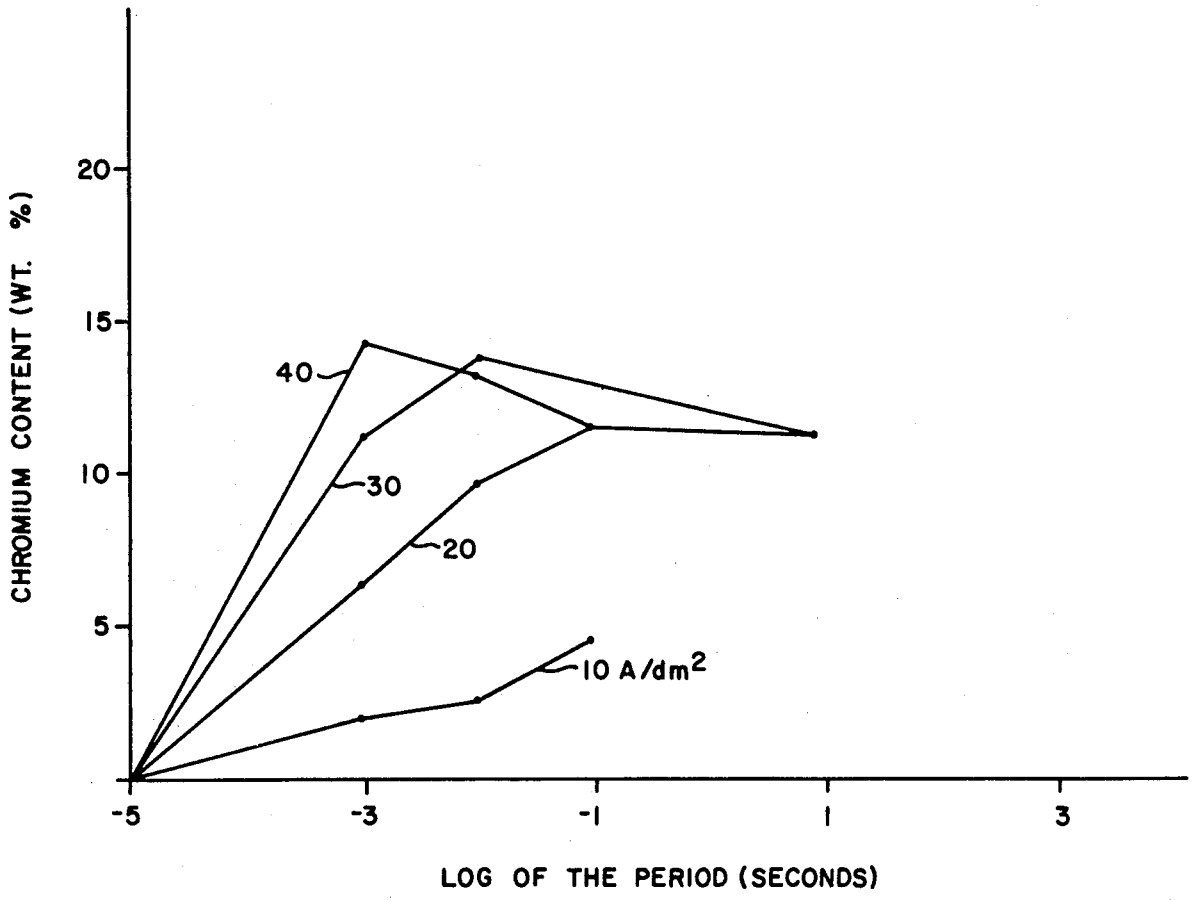
FIG. 3 is a plot of chromium content as a function of the logarithm of the period, for four different current densities.

The current density, the Duty Cycle and the Period each have an affect on the deposit. Variation of current density for various Duty Cycles, using a fixed On Time of 2 milliseconds, shows that chromium content increases as current density increases, for all Duty Cycles from 20 to 90% (FIG. 2). The higher the Duty Cycle, the higher the chromium content, for the same current density. Variation of the period at a fixed Duty Cycle of 20% and at various current densities resulted in variation of the chromium content (FIG. 3). Local maxima can be seen for periods in the millisecond range.

The base height can be positive, negative or zero, the latter being convenient for studying variations in other parameters. Negative base current density provides cathodic protection by reducing corrosion processes during Off Time. Positive base current density can be useful to reduce surface roughening, especially when plating near the limiting current density of the system.

There is a significant difference in the surface morphology of alloy deposits produced with pulsed galvanostatic deposition, as a function of different waveforms. In general, direct current deposit will produce a rougher surface than pulsed current deposition for the same current density. The Duty Cycle also affects the surface roughness, and it is generally the case that smoother deposits are produced at lower duty cycles. Also, shorter periods generally produce smoother coatings for the same Duty Cycle. Control of pH and temperature to keep these factors substantially constant will also produce a more uniform deposit.

For most pulsed electrodeposition applications it will be advantageous to set the relevant parameters in the following ranges:

| Parameter | Broad | Preferred |
|---|---|---|
| Period (msec) | 0.05–10 | 0.1 |
| Duty Cycle (%) | 20–80 | 25–50 |
| Current Density (A/dm$^2$) | 5–100 | 25–50 |
| Base Height (A/dm$^2$) | −10–+10 | 0 |

It will be appreciated that the foregoing ranges are illustrative and not limitative of the broad scope of this invention. A wide range of variability is possible for the pulsed deposition process, permitting extensive control of the process and allowing the chromium content, the surface morphology and the layering of the deposit to be controlled. This in turn translates into significant control over the resultant properties of the alloy coating. Depending upon the ultimate use, the properties of greatest concern can be controlled to maximize the desired characteristics.

The electrodeposition process of the invention can be effected using standard cells and electrodes, e.g., rotating disc electrodes. Preferably, anodic reactions are minimized by the use of anode/cathode surface area ratios of at least 2/1, and by the use of low polarization anodes. A nickel, nickel-chromium or platinum anode can be used, as can the usual commercial anodes, e.g., lead, graphite, platinized titanium and the like. Anodic reactions are generally not important but separate anode and cathode compartments can be used to prevent diffusion of anodic decomposition products into the cathode plating compartment. For example, semipermeable membranes, e.g., Nafion membranes, can be used to separate the anodic and cathodic regions, especially when readily decomposable complexing agents, e.g., glycine, are used.

Without further elaboration, it is believed that one skilled in the art can, using the preceding description, utilize the present invention to its fullest extent. The following preferred specific embodiments are, therefore, to be construed as merely illustrative, and not limitative of the remainder of the disclosure in any way whatsoever. In the following examples, all temperatures are set forth uncorrected in degrees Celsius; unless otherwise indicated, all parts and percentages are by weight.

EXAMPLE 1

Comparative Test of Throwing Power

The throwing powers of a plating bath according to the present invention and a nickel-chromium sulfate plating bath according to U.S. Pat. No. 3,888,744 (Stromatt) were compared under identical conditions in a standard Hull Cell, at 3 amps DC for 5 minutes. Each bath was prepared using standard shelf reagents and distilled water. The Stromatt bath had the composition shown in Example I of the patent, 0.15 M NaEDTA, pH 2.4. The bath according to the present invention had pH 2, and the composition:

| Constituent | Amount |
|---|---|
| $NiCl_2.6H_2O$ | 30 g/l |
| $CrCl_3.6H_2O$ | 100 g/l |
| Formic Acid (95%) | 40 ml/l |
| NaBr | 15 g/l |
| $NH_4Cl$ | 50 g/l |
| Boric Acid | 30 g/l |
| Glycolic Acid | 50 g/l |
| Sodium Citrate Dihydrate | 80 g/l |
| Triton X-100 (100%) | 1 drop/l |

The Stromatt bath plated out to a distance of 49 mm, while the bath according to the invention plated out to a distance of 71 mm with improved surface morphology, showing the significantly greater throwing power of the present bath.

EXAMPLE 2

Microhardness

Microhardness measurements were carried out with a Vickers indenter at the indicated load of 25 or 50 grams, using a calibrated standard periodically to insure proper operation of the instrument.

| | |
|---|---|
| $NiCl_2.6H_2O$ | 30 g/l |
| $CrCl_3.6H_2O$ | 100 g/l |
| NaBr | 15 g/l |
| $Na_3C_6H_5O_7.2H_2O$ (Sodium Citrate Dihydrate) | 80 g/l |
| $H_3BO_3$ | 40 g/l |
| HCOOH (95%) | 30 ml/l |

Electrodeposition was effected at about 35° C. and at pH 3.5, with zero Amp Off Time current, in a Pyrex cell containing about 0.5 liter of electrolyte, using either platinum or high-purity carbon anodes. The samples were coated rotating disc electrodes about 1 cm in diameter. Other diameters, as well as other geometries, have also been used successfully.

The results are shown in Table I:

TABLE I

| Current Density | Vickers Hardness (VHN) | Load (g) | pH |
|---|---|---|---|
| 15 DC | 700 ± 40 | 25 | 2.6 |
| 10 DC | 615 ± 13 | 25 | 2.6 |
| 10 DC | 785 ± 80 | 50 | 3.5 |
| 15 | 750 ± 14 | 50 | 3.5 |

(1ms period, 50% duty)

Microhardness measurements above 800 $VHN_{50}$ have been observed for nickel-chromium coatings according to the invention: the data show average values.

EXAMPLE 3

Wear Performance

Dry sliding wear tests were carried out using the procedure of Ruff et al., in "Selection and Use of Wear Tests for Coatings", ASTM, STP769, Bayer, Ed., ASTM, 1982, pgs. 134–156. Using the same bath and conditions as in Example 2 (CD 10 A/dm$^2$), coatings were formed on uniformly heat-treated 0–2 tool steel flat blocks against which a 52100 steel ring bearing was rotated at loads of 1 N. The apparatus was enclosed and filled with argon. The coatings tested were about 75 μm thick. The sliding distance was approximately 20 cm/s, the test duration was 1 hour and the ring diameter was about 35 cm. The instrumentation was designed to simultaneously measure the wear rate and the coefficient of friction as a function of sliding distance (revolutions of the bearing). Comparisons were made between electrodeposited nickel, nickel-chromium alloy, nickel-phosphorus, and hardened high carbon 0–2 tool steel alloy. The results are shown in Table II.

TABLE II

| COATING | FRICTION COEFFICIENT | WEAR RATE ($10^{-4}$ mm$^3$/m) |
|---|---|---|
| nickel (from a sulfamate electrolyte, 2 A/dm$^2$) | 0.97 | 3.4 |
| nickel-chromium (20 wt. %, 450 $KHN_{50}$) | 0.98 | 2.3 |
| 0-2 tool steel (hardened, 670 $KHN_{50}$) | 0.71 | 1.1 |
| Ni-P (12 wt % P) homogeneous | 0.8 | 1.3 ± 0.2 |
| Ni-P (12 wt % P) Composition modulated or layered. | 0.78 | 0.99 ± 0.16 |

EXAMPLE 4

Corrosion Performance

Accelerated corrosion tests were effected on pulse-plated nickel-chromium alloys, deposited with the electrolyte and under the conditions described in Example 2. The tests were effected in 3 wt. % sodium chloride, at 23° C., using potentiodynamic anodic polarization, as described in ASTM G5-78 (1982), comparing the nickel-chromium alloys with sulfamate nickel, bulk 316 L stainless steel and bulk brass. The results are shown in Table III.

TABLE III

| COATING | DEP. PARAM. | $E_p$ (mV) vs. SCE | $E_{corr}$(mV) vs. SCE | PASSIVE REG. (mV) vs. SCE | $i_{corr}$ n amps/cm$^2$ |
|---|---|---|---|---|---|
| Ni | 2 A/dm$^2$ | −130 | −484 | −450 to +20 | $4 \times 10^2$ |
| 316 L | Bulk | >−135 | −132 | −120 to −380 | $4 \times 10^3$ |
| Brass | Bulk | none | −248 | none | $7 \times 10^4$ |
| Ni-Cr | DC | −30 | −378 | −350 to −160 | $8 \times 10^3$ |
| Ni-Cr | 50% duty, 12 A/dm$^2$ | −78 | −387 | −350 to −100 | $6 \times 10^3$ |
| Ni-Cr | 20% duty, 25 A/dm$^2$ | −110 | −460 | −410 to −180 | $9 \times 10^3$ |
| Ni-Cr | 20% duty, 20 A/dm$^2$ | −110 | −392 | −350 to −90 | $3 \times 10^3$ |

Data were obtained from voltammetry curves, such as that shown in FIG. 4, which shows a pitting scan, directed towards determining the tendency of a material to undergo surface pitting or crevicing when placed in a specific corrosive environment. A pitting scan is a semi-log potential-current plot obtained by successive controlled-potential forward and reverse scans, beginning at $E_{corr}$, the corrosion potential, and ending at a final potential generally intermediate between the first vertex of the anodic scan and $E_{corr}$. $E_{corr}$ is defined as the point(s) of intersection of the anodic and cathodic scans. Only the highest (negative) potential is shown in the table. The protection potential, $E_p$, is defined as the point where the reverse scan intersects the forward scan. The passive region extends between the first anodic vertex and the anodic current "knee", i.e., the point where the current begins to increase very rapidly with applied potential. The corrosion current, $i_{corr}$, is the anodic current density corresponding to the potential at $E_{corr}$.

The results show that the passivating region of Ni-Cr alloys according to the invention is narrower than that of stainless steel or sulfamate nickel. However, the significantly more positive protection potential of the Ni-Cr coatings, reflecting the strong tendency of the current to drop upon reversal of the potential, reveals their extreme resistance to pitting. As noted hereinabove, this excellent corrosion behavior is related to the layered microstructure of these alloy deposits.

Similar corrosion tests in a sulfuric acid solution revealed that the Ni-Cr coatings of the invention have a very strong tendency to passivate, making them resistant to corrosion in acid, compared with stainless steel, sulfamate nickel and hard chromium.

The preceding examples can be repeated with similar success by substituting the generically or specifically described reactants and/or operating conditions of this invention for those used in the preceding examples. From the foregoing description, one skilled in the art can easily ascertain the essential characteristics of this invention, and without departing from the spirit and scope thereof, can make various changes and modifications of the invention to adapt it to various usages and conditions.

What is claimed is:

1. A process for the electrodeposition of a nickel-chromium alloy on a cathodic substrate, comprising:

contacting the substrate with an aqueous electrolyte containing: about 50–125 g/l of $CrCl_3.6H_2O$; about 10–125 g/l of $NiCl_2.6H_2O$; about 10–115 g/l of formic acid; about 25–50 g/l of boric acid; and about 50–100 g/l of sodium citrate dihydrate;

adjusting the pH of the bath to about 1–5 and the temperature to about 20°–60° C.; and passing a sufficient current through the solution and to the substrate to effect deposition thereon of a nickel-chromium alloy.

2. The process of claim 1, wherein said electrolyte contains up to about 75 g/l of glycolic acid.

3. The process of claim 1, wherein said electrolyte contains up to about 20 g/l of sodium bromide or ammonium bromide.

4. The process of claim 1, wherein said electrolyte contains up to about 75 g/l of ammonium chloride.

5. The process of claim 1, wherein said temperature is about 35° C.

6. The process of claim 1, wherein said pH is about 3.5.

7. The process of claim 1, wherein said current is direct current.

8. The process of claim 1, wherein said current is a pulsed current.

9. the process of claim 8, wherein the period is 0.05–10 milliseconds; the duty cycle is 20–80%; the base height is −10–+10 A/dm$^2$; and the peak height is 5–100 A/dm$^2$.

10. The process of claim 1, wherein said nickel-chromium alloy deposit is at least about 75 microns thick.

11. The process of claim 1, wherein the chromium content of said nickel-chromium alloy deposit is at least about 20% by weight.

12. An aqueous electrolyte for electroplating nickel-chromium alloys by electrodeposition, consisting essentially of an aqueous solution containing: about 50–125 g/l of $CrCl_3.6H_2O$ ; about 10–125 g/l of $NiCl_2.6H_2O$; about 10–115 g/l of formic acid; about 25–50 g/l of boric acid; and about 50–100 g/l of sodium citrate; said solution having a pH of 1–5.

13. The electrolyte of claim 12, which further contains up to about 75 g/l of glycolic acid.

14. The electrolyte of claim 12, which further contains up to about 20 g/l of sodium bromide or ammonium bromide.

15. The electrolyte of claim 12, which further contains up to about 75 g/l of ammonium chloride.

16. The electrolyte of claim 12, having a pH of 3.5.

* * * * *